US010161241B2

(12) United States Patent
Snider et al.

(10) Patent No.: US 10,161,241 B2
(45) **Date of Patent: *Dec. 25, 2018**

(54) REVERSE FLOW SLEEVE ACTUATION METHOD

(71) Applicant: GEODynamics, Inc., Millsap, TX (US)

(72) Inventors: Philip M Snider, Tomball, TX (US); David S Wesson, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/472,062

(22) Filed: Mar. 28, 2017

(65) Prior Publication Data

US 2017/0198565 A1 Jul. 13, 2017

Related U.S. Application Data

(63) Continuation of application No. 14/877,784, filed on Oct. 7, 2015, now Pat. No. 9,611,721.

(60) Provisional application No. 62/210,244, filed on Aug. 26, 2015.

(51) Int. Cl.

| | |
|---|---|
| ***E21B 34/14*** | (2006.01) |
| ***E21B 47/06*** | (2012.01) |
| ***E21B 47/09*** | (2012.01) |
| ***E21B 23/08*** | (2006.01) |
| *E21B 34/00* | (2006.01) |

(52) U.S. Cl.

CPC ..... *E21B 47/06* (2013.01); *E21B 23/08* (2013.01); *E21B 34/14* (2013.01); *E21B 47/09* (2013.01); *E21B 2034/007* (2013.01)

(58) Field of Classification Search

CPC ..... E21B 34/14

See application file for complete search history.

(56) References Cited

U.S. PATENT DOCUMENTS

| | | | | |
|---|---|---|---|---|
| 2,117,534 | A | 5/1938 | Baker | |
| 2,752,861 | A | 7/1956 | Hill | |
| 2,829,719 | A | 4/1958 | Clark, Jr. | |
| 3,054,415 | A | 9/1962 | Baker et al. | |
| 3,776,258 | A | 12/1973 | Dockins, Jr. et al. | |
| 9,611,721 | B2 * | 4/2017 | Snider | E21B 34/12 |
| 2004/0163820 | A1 | 8/2004 | Bishop et al. | |
| 2009/0056952 | A1 | 3/2009 | Churchill | |

(Continued)

FOREIGN PATENT DOCUMENTS

| | | | |
|---|---|---|---|
| WO | 2014043807 | A1 | 3/2014 |
| WO | 2015065474 | A2 | 5/2015 |
| WO | 2015109407 | A1 | 7/2015 |

OTHER PUBLICATIONS

European Patent Office, European Search Report for EP 16184462 dated Jan. 26, 2017.

*Primary Examiner* — Robert E Fuller

(74) *Attorney, Agent, or Firm* — Patent Portfolio Builders PLLC

(57) ABSTRACT

A sleeve actuation method for actuating sleeves in a reverse direction. The method includes a use of stored energy created by injecting into a connected region of a well such that the stored energy is used to actuate a tool installed in a wellbore casing that is either heel ward or uphole of the connected region. The tool actuated in a direction from toe end to heel end while the tool reconfigures to create a seat for seating plugging elements.

6 Claims, 13 Drawing Sheets

(56) References Cited

U.S. PATENT DOCUMENTS

| | | | | |
|---|---|---|---|---|
| 2010/0089587 | A1 | 4/2010 | Stout | |
| 2012/0227973 | A1 | 9/2012 | Hart et al. | |
| 2012/0234534 | A1* | 9/2012 | Hughes | E21B 33/05 166/255.1 |
| 2013/0037273 | A1 | 2/2013 | Themig et al. | |
| 2013/0153220 | A1 | 6/2013 | Carter et al. | |
| 2013/0264051 | A1 | 10/2013 | Kyle et al. | |
| 2014/0158368 | A1 | 6/2014 | Hoffman et al. | |
| 2014/0318815 | A1 | 10/2014 | Merron | |
| 2016/0258280 | A1 | 9/2016 | Murphree et al. | |
| 2017/0015838 | A1 | 3/2017 | Hardesty et al. | |
| 2017/0058634 | A1 | 3/2017 | Roessler et al. | |
| 2017/0058637 | A1 | 3/2017 | Roessler et al. | |
| 2017/0058639 | A1 | 3/2017 | Hardesty et al. | |
| 2017/0058640 | A1 | 3/2017 | Roessler et al. | |
| 2017/0058641 | A1 | 3/2017 | Hardesty et al. | |
| 2017/0058642 | A1 | 3/2017 | Roessler et al. | |
| 2017/0058643 | A1 | 3/2017 | Snider et al. | |

* cited by examiner

*Prior Art*

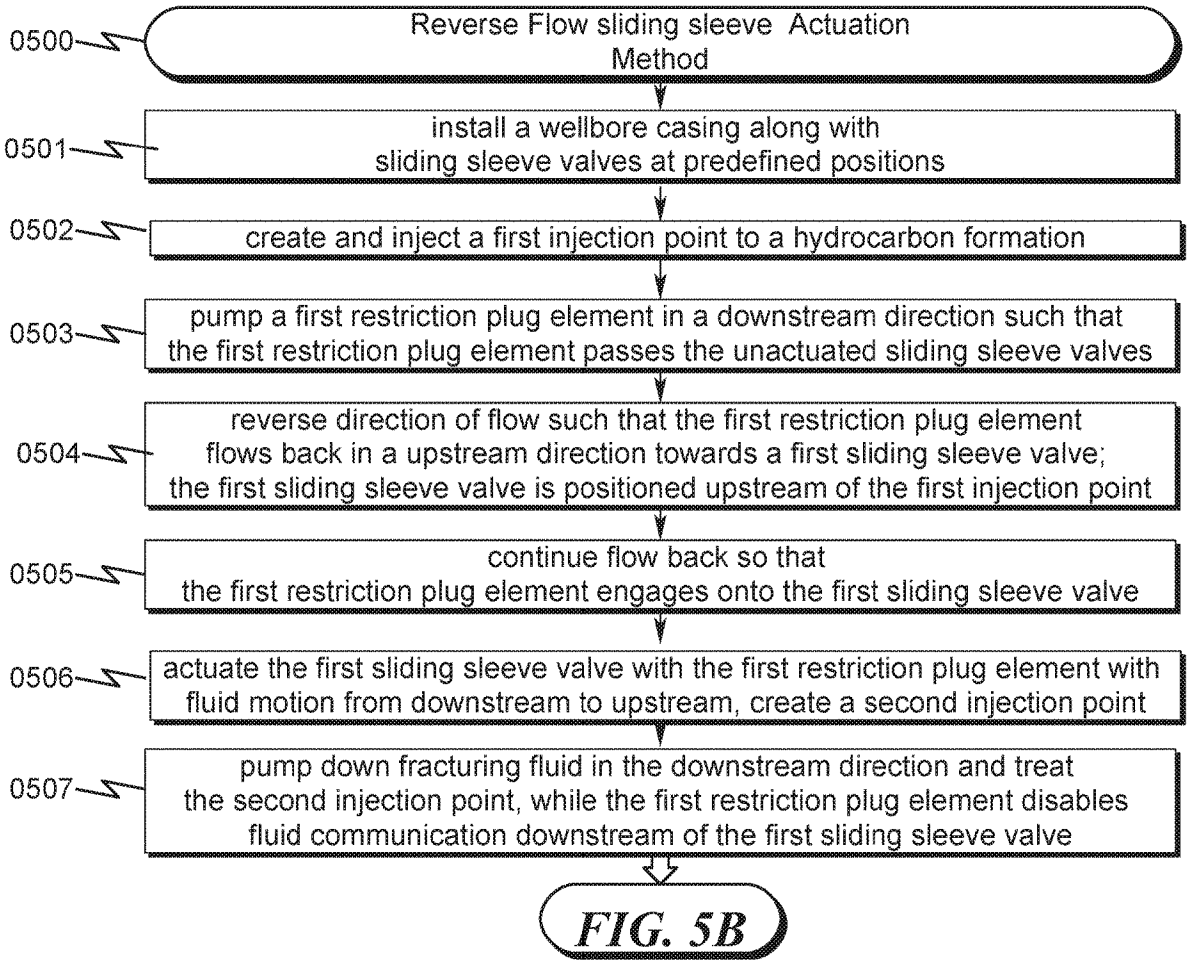
FIG. 5A
Reverse Flow sliding sleeve Actuation Method
0500
install a wellbore casing along with sliding sleeve valves at predefined positions
0501
create and inject a first injection point to a hydrocarbon formation
0502
pump a first restriction plug element in a downstream direction such that the first restriction plug element passes the unactuated sliding sleeve valves
0503
reverse direction of flow such that the first restriction plug element flows back in a upstream direction towards a first sliding sleeve valve; the first sliding sleeve valve is positioned upstream of the first injection point
0504
continue flow back so that the first restriction plug element engages onto the first sliding sleeve valve
0505
actuate the first sliding sleeve valve with the first restriction plug element with fluid motion from downstream to upstream, create a second injection point
0506
pump down fracturing fluid in the downstream direction and treat the second injection point, while the first restriction plug element disables fluid communication downstream of the first sliding sleeve valve
0507
FIG. 5B

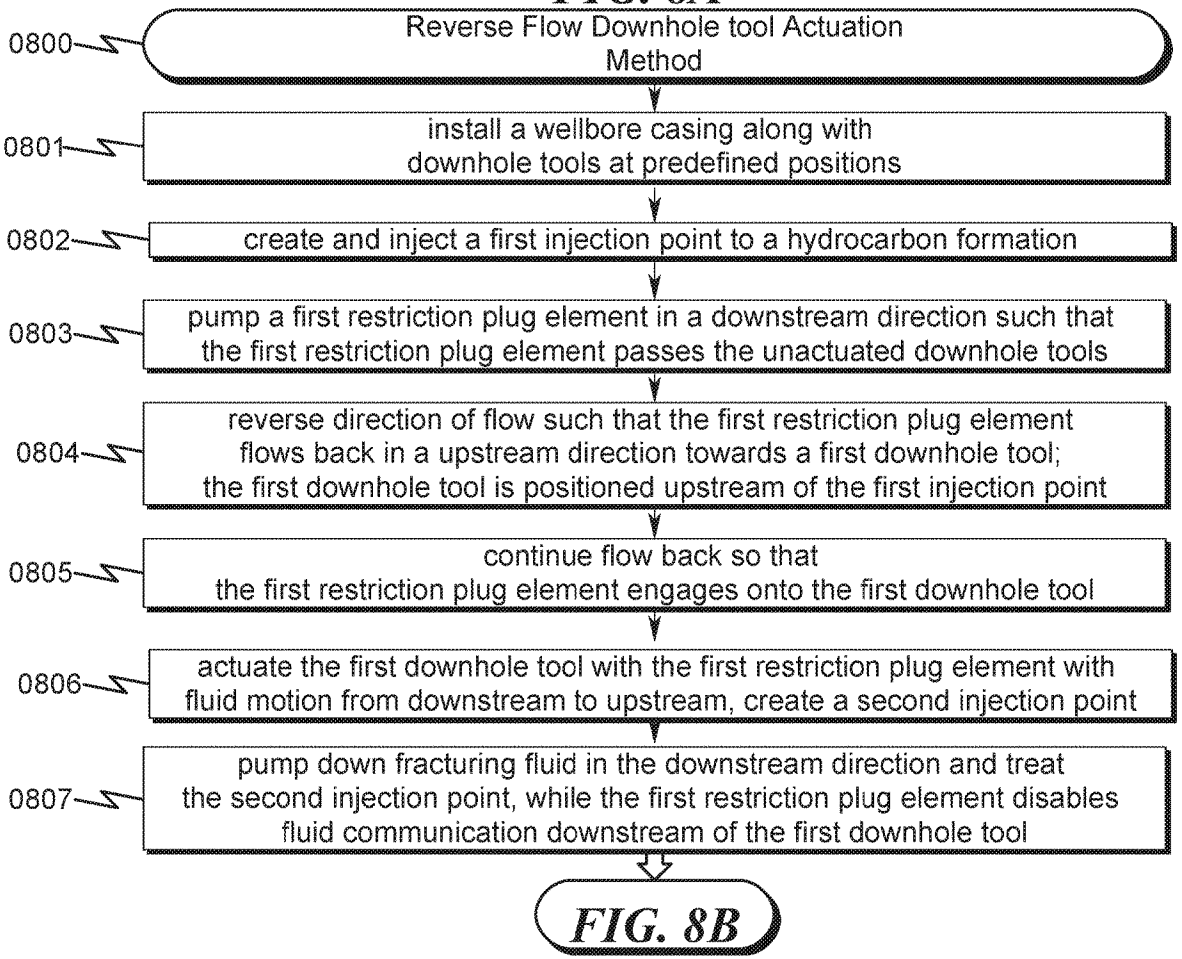
FIG. 8A
Reverse Flow Downhole tool Actuation Method
0800
install a wellbore casing along with downhole tools at predefined positions
0801
create and inject a first injection point to a hydrocarbon formation
0802
pump a first restriction plug element in a downstream direction such that the first restriction plug element passes the unactuated downhole tools
0803
reverse direction of flow such that the first restriction plug element flows back in a upstream direction towards a first downhole tool; the first downhole tool is positioned upstream of the first injection point
0804
continue flow back so that the first restriction plug element engages onto the first downhole tool
0805
actuate the first downhole tool with the first restriction plug element with fluid motion from downstream to upstream, create a second injection point
0806
pump down fracturing fluid in the downstream direction and treat the second injection point, while the first restriction plug element disables fluid communication downstream of the first downhole tool
0807
FIG. 8B

REVERSE FLOW SLEEVE ACTUATION METHOD

CROSS REFERENCE TO RELATED APPLICATIONS

This application is a continuation of U.S. application Ser. No. 14/877,784, filed Oct. 7 2015, which claims the benefit of U.S. Provisional Application No. 62/210,244, filed Aug. 26, 2015, the disclosures of which are fully incorporated herein by reference.

FIELD OF THE INVENTION

The present invention generally relates to oil and gas extraction. Specifically, the invention uses stored energy in a connected region of a hydrocarbon formation to generate reverse flow that actuates tools in a wellbore casing.

PRIOR ART AND BACKGROUND OF THE INVENTION

Prior Art Background

The process of extracting oil and gas typically consists of operations that include preparation, drilling, completion, production and abandonment.

In the drilling of oil and gas wells, a wellbore is formed using a drill bit that is urged downwardly at a lower end of a drill string. After drilling the wellbore is lined with a string of casing.

Open Hole Well Completions

Open hole well completions use hydraulically set mechanical external packers instead of bridge plugs and cement to isolate sections of the wellbore. These packers typically have elastomer elements that expand to seal against the wellbore and do not need to be removed, or milled out, to produce the well. Instead of perforating the casing to allow fracturing, these systems have sliding sleeve tools to create ports in between the packers. These tools can be opened hydraulically (at a specific pressure) or by dropping size-specific actuation balls into the system to shift the sleeve and expose the port. The balls create internal isolation from stage to stage, eliminating the need for bridge plugs. Open hole completions permit fracture treatments to be performed in a single, continuous pumping operation without the need for a drilling rig. Once stimulation treatment is complete, the well can be immediately flowed back and production brought on line. The packer may sustain differential pressures of 10,000 psi at temperatures up to 425° F. and set in holes enlarged up to 50%.

Ball Sleeve Operation

The stimulation sleeves have the capability to be shifted open by landing a ball on a ball seat. The operator can use several different sized dropping balls and corresponding ball-landing seats to treat different intervals. It is important to note that this type of completion must be done from the toe up with the smallest ball and seat working the bottom/lowest zone. The ball activated sliding sleeve has a shear-pinned inner sleeve that covers the fracture ports. A ball larger than the cast iron baffle in the bottom of the inner sleeve is pumped down to the seat on the baffle. A pressure differential sufficient to shear the pins holding the inner sleeve closed is reached to expose and open the fracture ports. When a ball meets its matching seat in a sliding sleeve, the pumped fluid forced against the seated ball shifts the sleeve open and aligns the ports to treat the next zone. In turn, the seated ball diverts the pumped fluid into the adjacent zone and prevents the fluid from passing to previously treated lower zones towards the toe of the casing. By dropping successively increasing sized balls to actuate corresponding sleeves, operators can accurately treat each zone up the wellbore.

The balls can be either drilled up or flowed back to surface once all the treatments are completed. The landing seats are made of a drillable material and can be drilled to give a full wellbore inner diameter. Using the stimulation sleeves with ball-activation capability removes the need for any intervention to stimulate multiple zones in a single wellbore. The description of stimulation sleeves, swelling packers and ball seats are as follows:

Stimulation Sleeve

The stimulation sleeve is designed to be run as part of the casing string. It is a tool that has communication ports between an inner diameter and an outer diameter of a wellbore casing. The stimulation sleeve is designed to give the operator the option to selectively open and close any sleeve in the casing string (up to 10,000 psi differentials at 350° F.).

Swelling Packer

The swelling packer requires no mechanical movement or manipulation to set. The technology is the rubber compound that swells when it comes into contact with any appropriate liquid hydrocarbon. The compound conforms to the outer diameter that swells up to 115% by volume of its original size.

Ball Seats

These are designed to withstand the high erosional effects of fracturing and the corrosive effects of acids. Ball seats are sized to receive/seat balls greater than the diameter of the seat while passing through balls that have a diameter less that the seat.

Because the zones are treated in stages, the lowermost sliding sleeve (toe ward end or injection end) has a ball seat for the smallest sized ball diameter size, and successively higher sleeves have larger seats for larger diameter balls. In this way, a specific sized dropped ball will pass though the seats of upper sleeves and only locate and seal at a desired seat in the well casing. Despite the effectiveness of such an assembly, practical limitations restrict the number of balls that can be run in a single well casing. Moreover, the reduced size of available balls and ball seats results in undesired low fracture flow rates.

Prior Art System Overview (0100)

As generally seen in a system diagram of FIG. 1 (0100), prior art systems associated with open hole completed oil and gas extraction may include a wellbore casing (0101) laterally drilled into a bore hole in a hydrocarbon formation. It should be noted the prior art system (0100) described herein may also be applicable to cemented wellbore casings. An annulus is formed between the wellbore casing (0101) and the bore hole.

The wellbore casing (0101) creates a plurality of isolated zones within a well and includes an port system that allows selected access to each such isolated zone. The casing (0101) includes a tubular string carrying a plurality of packers (0110, 0111, 0112, 0113) that can be set in the annulus to create isolated fracture zones (0160, 0161, 0162, 0163). Between the packers, fracture ports opened through the inner and outer diameters of the casing (0101) in each isolated zone are positioned. The fracture ports are sequentially opened and include an associated sleeve (0130, 0131, 0132, 0133) with an associated sealable seat formed in the inner diameter of the respective sleeves. Various diameter balls (0150, 0151, 0152, 0153) could be launched to seat in their respective seats. By launching a ball, the ball can seal against the seat and pressure can be increased behind the ball to drive the sleeve along the casing (0101), such driving allows a port to open one zone. The seat in each sleeve can be formed to accept a ball of a selected diameter but to allow balls of lower diameters to pass. For example, ball (0150) can be launched to engage in a seat, which then drives a sleeve (0130) to slide and open a fracture port thereby isolating the fracture zone (0160) from downstream zones. The toe ward sliding sleeve (0130) has a ball seat for the smallest diameter sized ball (0150) and successively heel ward sleeves have larger seats for larger balls. As depicted in FIG. 1, the ball (0150) diameter is less than the ball (0151) diameter which is less than the ball (0152) diameter and so on. Therefore, limitations with respect to the inner diameter of wellbore casing (0101) may tend to limit the number of zones that may be accessed due to limitation on the size of the balls that are used. For example, if the well diameter dictates that the largest sleeve in a well casing (0101) can at most accept a 3 inch ball diameter and the smallest diameter is limited to 2 inch ball, then the well treatment string will generally be limited to approximately 8 sleeves at ⅛ inch increments and therefore can treat in only 8 fracturing stages. With $1/16^{th}$ inch increments between ball diameter sizes, the number of stages is limited to 16. Limiting number of stages results in restricted access to wellbore production and the full potential of producing hydrocarbons may not be realized. Therefore, there is a need for actuating sleeves with actuating elements to provide for adequate number of fracture stages without being limited by the size of the actuating elements (restriction plug elements), size of the sleeves, or the size of the wellbore casing.

Prior Art Method Overview (0200)

As generally seen in the method of FIG. 2 (0200), prior art associated with oil and gas extraction includes site preparation and installation of a bore hole in step (0201). In step (0202) preset sleeves may be fitted as an integral part of the wellbore casing (0101) that is installed in the wellbore. The sleeves may be positioned to close each of the fracture ports disallowing access to hydrocarbon formation. After setting the packers (0110, 0111, 0112, 0113) in step (0202), sliding sleeves are actuated by balls to open fracture ports in step (0203) to enable fluid communication between the well casing and the hydrocarbon formation. The sleeves are actuated in a direction from upstream to downstream. Prior art methods do not provide for actuating sleeves in a direction from downstream to upstream. In step (0204), hydraulic fracturing fluid is pumped through the fracture ports at high pressures. The steps comprise launching an actuating ball, engaging in a ball seat, opening a fracture port (0203), isolating a hydraulic fracturing zone, and hydraulic fracturing fluids into the perforations (0204), are repeated until all hydraulic fracturing zones in the wellbore casing are fractured and processed. The fluid pumped into the fracture zones at high pressure remains in the connected regions. The pressure in the connected region (stored energy) is diffused over time. Prior art methods do not provide for utilizing the stored energy in a connected region for useful work such as actuating sleeves. In step (0205), if all hydraulic fracturing zones are processed, all the actuating balls are pumped out or removed from the wellbore casing (0206). A complicated ball counting mechanism may be employed to count the number of balls removed. In step (0207) hydrocarbon is produced by pumping from the hydraulic fracturing stages.

Step (0203) requires that a right sized diameter actuating ball be deployed to seat in the corresponding sized ball seat to actuate the sliding sleeve. Progressively increasing diameter balls are deployed to seat in their respectively sized ball seats and actuating the sliding sleeves. Progressively sized balls limit the number stages in the wellbore casing. Therefore, there is a need for actuating sleeves with actuating elements to provide for adequate number of fracture stages without being limited by the size of the actuating elements, size of the sleeves, or the size of the wellbore casing. Moreover, counting systems use all the same size balls and actuate a sleeve on an "$n^{th}$" ball. For example, counting systems may count the number of balls dropped balls as 10 before actuating on the $10^{th}$ ball.

Furthermore, in step (0203), if an incorrect sized ball is deployed in error, all hydraulic fracturing zones toe ward (injection end) of the ball position may be untreated unless the ball is retrieved and a correct sized ball is deployed again. Therefore, there is a need to deploy actuating seats with constant inner diameter to actuate sleeves with actuating elements just before a hydraulic fracturing operation is performed. Moreover, there is a need to perform out of order hydraulic fracturing operations in hydraulic fracturing zones.

Additionally, in step (0206), a complicated counting mechanism is implemented to make certain that all the balls are retrieved prior to producing hydrocarbon. Therefore, there is a need to use degradable actuating elements that could be flown out of the wellbore casing or flown back prior to the surface prior to producing hydrocarbons.

Additionally, in step (0207), smaller diameter seats and sleeves towards the toe end of the wellbore casing might restrict fluid flow during production. Therefore, there is need for larger inner diameter actuating seats and sliding sleeves to allow unrestricted well production fluid flow. Prior to production, all the sleeves and balls need to be milled out in a separate step.

Deficiencies in the Prior Art

The prior art as detailed above suffers from the following deficiencies:

- Prior art systems do not provide for actuating sleeves with actuating elements to provide for adequate number of fracture stages without being limited by the size of the actuating elements, size of the sleeves, or the size of the wellbore casing.
- Prior art systems such as coil tubing may be used to open and close sleeves, but the process is expensive.
- Prior art methods counting mechanism to count the balls dropped into the casing is not accurate.
- Prior art systems do not provide for a positive indication of an actuation of a downhole tool.
- Prior art methods do not provide for determining the location of a downhole tool.
- Prior art systems do not provide for performing out of order hydraulic fracturing operations in hydraulic fracturing zones.
- Prior art systems do not provide for using degradable actuating elements that could be flown out of the wellbore casing or flown back prior to the surface prior to producing hydrocarbons.
- Prior art systems do not provide for setting constant diameter larger inner diameter sliding sleeves to allow unrestricted well production fluid flow.
- Prior art methods do not provide for actuating sleeves in a direction from downstream to upstream.
- Prior art methods do not provide for utilizing the stored energy in a connected region for useful work.

While some of the prior art may teach some solutions to several of these problems, the core issue of utilizing stored energy in a connected region for useful work has not been addressed by prior art.

BRIEF SUMMARY OF THE INVENTION

Method Overview

The present invention system may be utilized in the context of an overall hydrocarbon extraction method, wherein the reverse flow sleeve actuation method is described in the following steps:

(1) installing the wellbore casing along with sliding sleeve valves at predefined positions;

(2) creating and treating a first injection point to a hydrocarbon formation;

(3) pumping a first restriction plug element in a downstream direction such that the first restriction plug element passes the unactuated sliding sleeve valves;

(4) reversing direction of flow such that the first restriction plug element flows back in an upstream direction towards a first sliding sleeve valve; the first sliding sleeve valve positioned upstream of the first injection point;

(5) continuing flow back so that the first restriction plug element engages onto the unactuated first sliding sleeve valve;

(6) actuating the first sliding sleeve valve with the first restriction plug element with fluid motion from downstream to upstream and creating a second injection point;

(7) pumping down treatment fluid in the downstream direction and treating the second injection point, while the first restriction plug element disables fluid communication downstream of the first sliding sleeve valve;

(8) pumping a second restriction plug element in a downstream direction such that the second restriction plug element passes through the unactuated sliding sleeve valves;

(9) seating the second restriction plug element in the first sliding sleeve valve;

(10) reversing direction of flow such that the second restriction plug element flows back in an upstream direction towards a second sliding sleeve valve positioned upstream of the second injection point;

(11) continuing flow back so that the second restriction plug element changes shape and engages onto the second sliding sleeve valve;

(12) actuating the second sliding sleeve valve with the second restriction plug element with fluid motion from downstream to upstream and creating a third injection point; and

(13) pumping down fracturing fluid in a downstream direction and treating the third injection point, while the restriction plug element disables fluid communication downstream of the second sliding sleeve valve.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein:

FIG. 5A-5B illustrate a detailed flowchart of a preferred exemplary reverse flow actuation of sliding sleeves method used in some preferred exemplary invention embodiments.

FIG. 8A-8B illustrate a detailed flowchart of a preferred exemplary reverse flow actuation of downhole tools method used in some preferred exemplary invention embodiments.

DESCRIPTION OF THE PRESENTLY PREFERRED EXEMPLARY EMBODIMENTS

Figure 1:
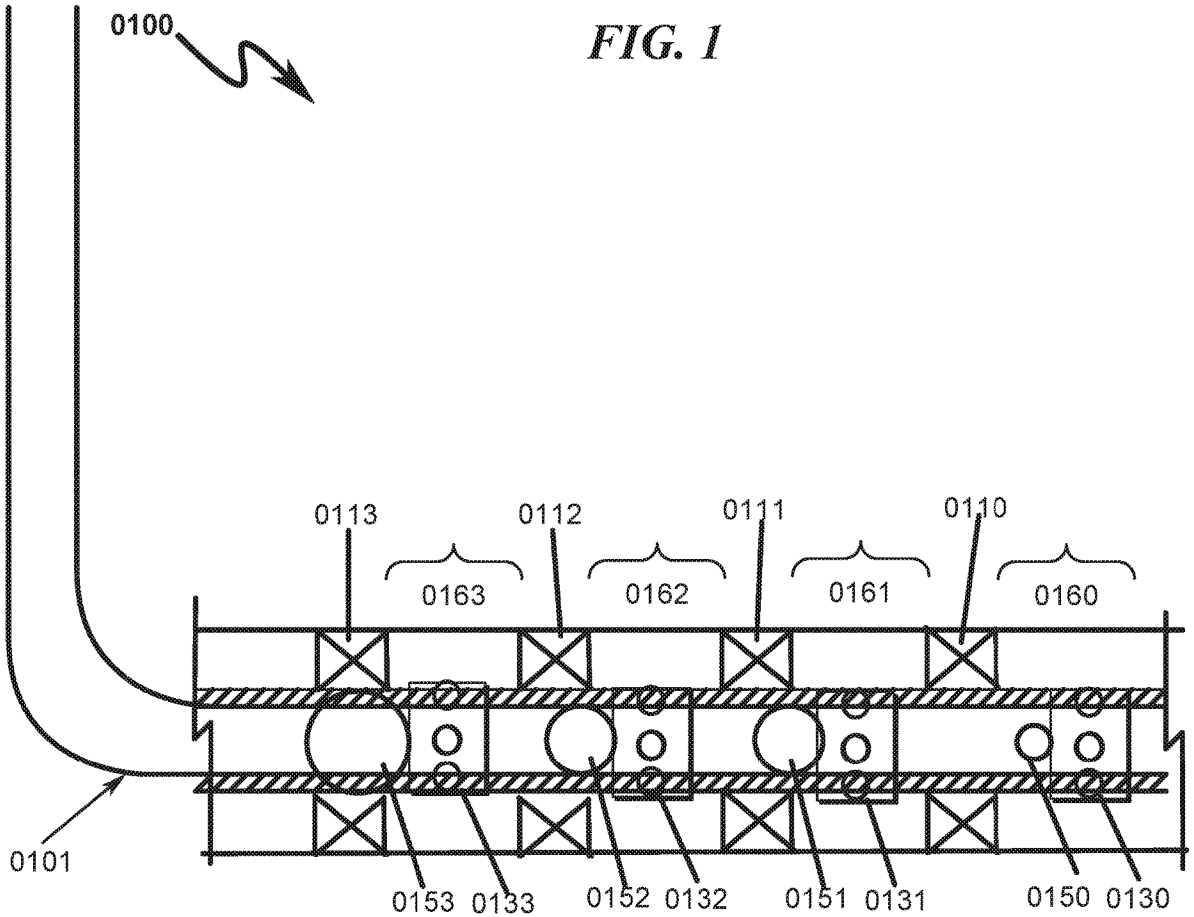
FIG. 1 Prior Art
FIG. 1 illustrates a system block overview diagram describing how prior art systems use ball seats to isolate hydraulic fracturing zones.
Figure 2:
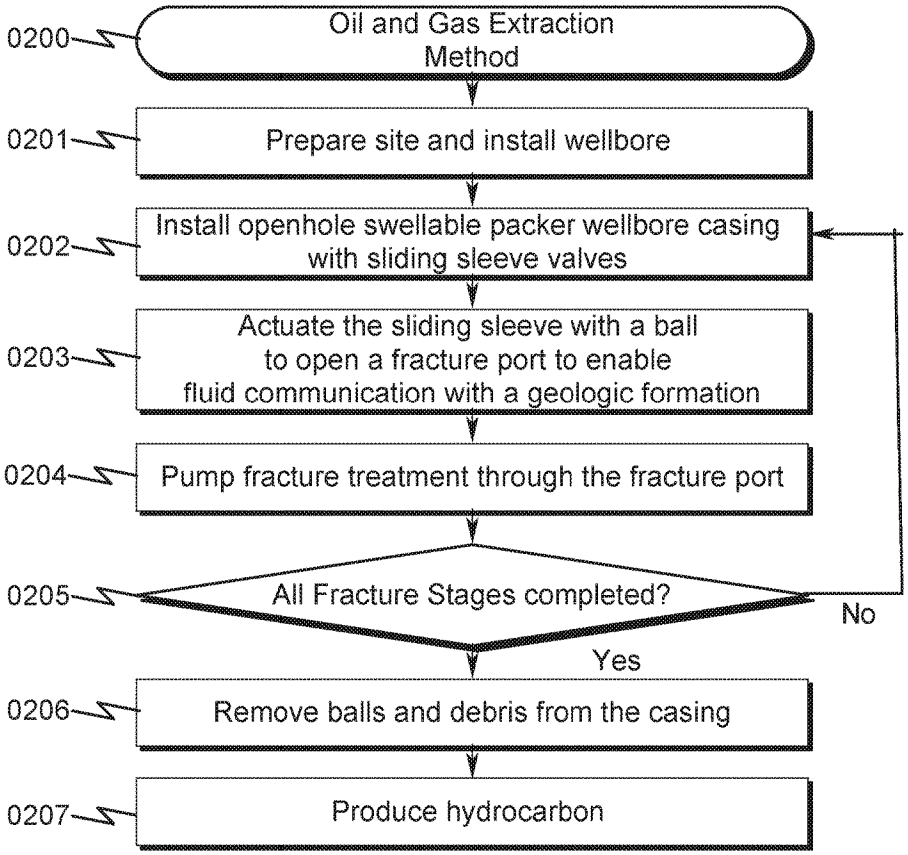
FIG. 2 illustrates a flowchart describing how prior art systems extract oil and gas from hydrocarbon formations.

While this invention is susceptible to embodiment in many different forms, there is shown in the drawings and will herein be described in detail, preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a reverse flow tool actuation method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

The term "heel end" as referred herein is a wellbore casing end where the casing transitions from vertical direction to horizontal or deviated direction. The term "toe end" described herein refers to the extreme end section of the horizontal portion of the wellbore casing adjacent to a float collar. The term "upstream" as referred herein is a direction from a toe end towards heel end. The term "downstream" as referred herein is a direction from a heel end to toe end. For example, when a fluid is pumped from the wellhead, the fluid moves in a downstream direction from heel end to toe end. Similarly, when fluid flows back, the fluid moves in an upstream direction from toe end to heel end. In a vertical or deviated well, the direction of flow during reverse flow may be uphole which indicates fluid flow in a direction from the bottom of the vertical casing towards the wellhead.

Objectives of The Invention

Accordingly, the objectives of the present invention are (among others) to circumvent the deficiencies in the prior art and affect the following objectives:

- Provide for actuating sleeves with actuating elements to provide for adequate number of fracture stages without being limited by the size of the actuating elements, size of the sleeves, or the size of the wellbore casing.
- Provide for performing out of order hydraulic fracturing operations in hydraulic fracturing zones.
- Provide for using degradable actuating elements that could be flown out of the wellbore casing or flown back prior to the surface prior to producing hydrocarbons.
- Eliminate need for coil tubing intervention.
- Eliminate need for a counting mechanism to count the balls dropped into a casing.
- Provide for setting larger inner diameter actuating sliding sleeves to allow unrestricted well production fluid flow.
- Provide for a method for determining a location of a sliding sleeve based on a monitored pressure differential.
- Provide for a method for determining a proper functioning of a sliding sleeve based on a monitored actuation pressure.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

Preferred Embodiment Reverse Flow

When fluid is pumped down and injected into a hydrocarbon formation, the local formation pressure temporarily rises in a region around the injection point. The rise in local formation pressure may depend on the permeability of the formation adjacent to the injection point. The formation pressure may diffuse away from the well over a period of time (diffusion time). During this period of diffusion time, the formation pressure results in stored energy source similar to a charged battery source in an electrical circuit. When the wellhead stops pumping fluid down either by closing a valve or other means, during the diffusion time, a "reverse flow" is achieved when energy is released back into the well. Reverse flow may be defined as a flow back mechanism where the fluid flow direction changes from flowing downstream (heel end to toe end) to flowing upstream (toe end to heel end). The pressure in the formation may be higher than the pressure in the well casing and therefore pressure is balanced in the well casing resulting in fluid flow back into the casing. The flow back due to pressure balancing may be utilized to perform useful work such as actuating a downhole tool such as a sliding sleeve valve. The direction of actuation is from downstream to upstream which is opposite to a conventional sliding sleeve valve that is actuated directionally from upstream to downstream direction. For example, when a restriction plug element such as a fracturing ball is dropped into the well bore casing and seats in a downhole tool, the restriction plug element may flow back due to reverse flow and actuate a sliding sleeve valve that is positioned upstream of the injection point. In a vertical or deviated well, the direction of flow during reverse flow may be uphole.

The magnitude of the local formation pressure may depend on several factors that include volume of the pumping fluid, pump down efficiency of the pumping fluid, permeability of the hydrocarbon formation, an open-hole log before casing is placed in a wellbore, seismic data that may include 3 dimensional formation of interest to stay in a zone, natural fractures and the position of an injection point. For example, pumping fluid into a specific injection point may result in an increase in the displacement of the hydrocarbon formation and therefore an increase in the local formation pressure, the amount, and duration of the local pressure.

The lower the permeability in the hydrocarbon formation, the higher the local formation pressure and the longer that pressure will persist.

Preferred Embodiment Reverse Flow Sleeve Actuation (0300-0390)

Figure 3:
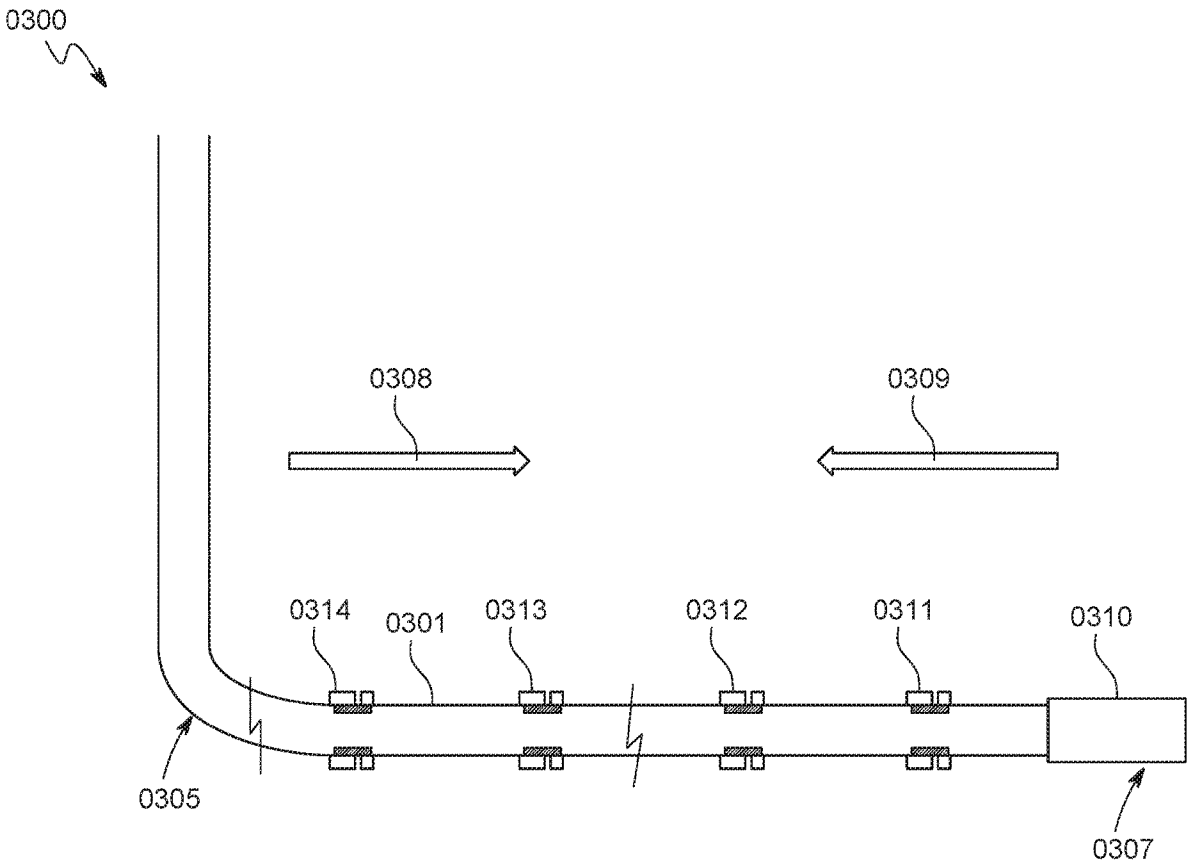
FIG. 3 illustrates an exemplary system overview depicting a wellbore casing along with sliding sleeve valves and a toe valve according to a preferred exemplary embodiment of the present invention.

FIG. 3 (0300) generally illustrates a wellbore casing (0301) comprising a heel end (0305) and a toe end (0307) and installed in a wellbore in a hydrocarbon formation. The casing (0301) may be cemented or may be installed in an open-hole. A plurality of downhole tools (0311, 0312, 0313, 0314) may be conveyed with the wellbore casing. A toe valve (0310) installed at a toe end (0307) of the casing may be conveyed along with the casing (0301). The toe valve (0310) may comprise a hydraulic time delay valve or a conventional toe valve. The downhole tools may be sliding sleeve valves, plugs, deployable seats, and restriction devices. It should be noted the 4 downhole tools (0311, 0312, 0313, 0314) shown in FIG. 3 (0300) are for illustration purposes only, the number of downhole tools may not be construed as a limitation. The number of downhole tools may range from 1 to 10,000. According to a preferred exemplary embodiment, a ratio of an inner diameter of any of the downhole tools to an inner diameter of the wellbore casing may range from 0.5 to 1.2. For example, the inner diameter of the downhole tools (0311, 0312, 0313, 0314) may range from 2¾ inch to 12 inches.

According to another preferred exemplary embodiment, the inner diameters of each of the downhole tools are equal and substantially the same as the inner diameter of the wellbore casing. Constant inner diameter sleeves may provide for adequate number of fracture stages without being constrained by the diameter of the restriction plug elements (balls), inner diameter of the sleeves, or the inner diameter of the wellbore casing. Large inner diameter sleeves may also provide for maximum fluid flow during production. According to yet another exemplary embodiment the ratio an inner diameter of consecutive downhole tools may range from 0.5 to 1.2. For example the ratio of the first sliding sleeve valve (0311) to the second sliding sleeve valve (0312) may range from 0.5 to 1.2. The casing may be tested for casing integrity followed by injecting fluid in a downstream direction (0308) into the hydrocarbon formation through openings or ports in the toe valve (0310). The connected region around the injection point may be energetically charged by the fluid injection in a downstream direction (0308) from a heel end (0305) to toe end (0307). The connected region may be a region of stored energy that may be released when fluid pumping rate from the well head ceases or reduced. The energy release into the casing may be in the form of reverse flow of fluid from the injection point towards a heel end (0305) in an upstream direction (0309). The connected region (0303) illustrated around the toe valve is for illustration purposes only and should not be construed as a limitation. According to a preferred exemplary embodiment, an injection point may be initiated in any of the downhole tools in the wellbore casing.

Figure 3A:
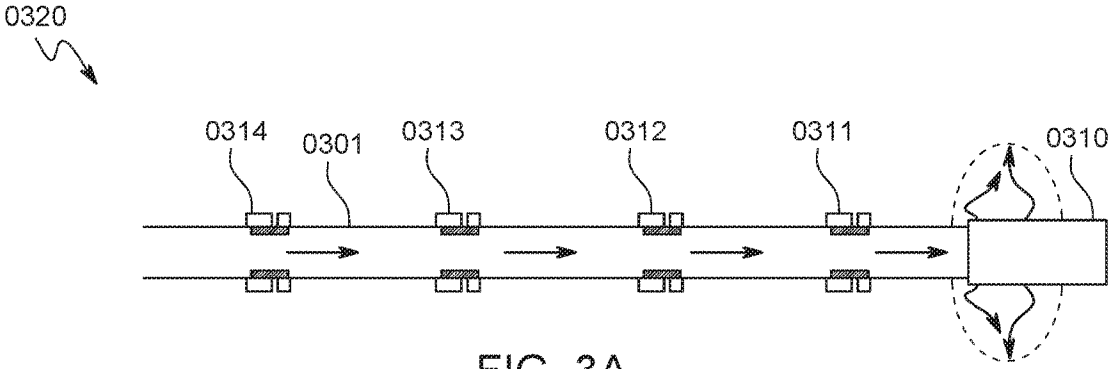
FIG. 3A-3H illustrate a system overview depicting an exemplary reverse flow actuation of downhole tools according to a presently preferred embodiment of the present invention.

FIG. 3A (0320) generally illustrates the wellbore casing (0301) of FIG. 3 (0300) wherein fluid is pumped into the casing at a pressure in a downstream direction (0308). The fluid may be injected through a port in the toe valve (0310) and establishing fluid communication with a hydrocarbon formation. The fluid that is injected into the casing at a pressure may displace a region (connected region, 0303) about the injection point. The connected region (0303) is a region of stored energy where energy may be dissipated or diffused over time. According to a preferred exemplary embodiment, the stored energy in the injection point may be utilized for useful work such as actuating a downhole tool.

Figure 3B:
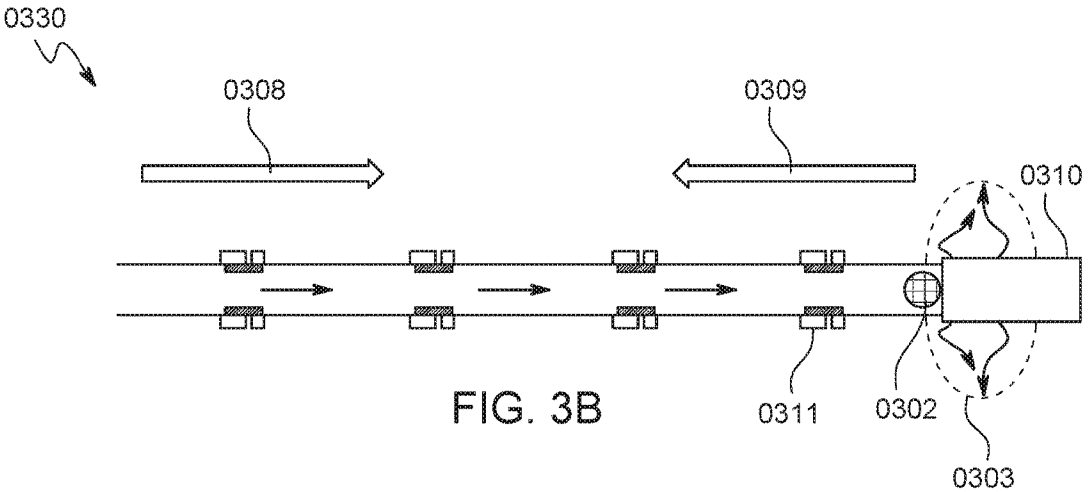

FIG. 3B (0330) generally illustrates a restriction plug element (0302) deployed into the wellbore casing (0301) after the injection point is created and fluid communication is established as aforementioned in FIG. 3A (0320). The plug is pumped in a downstream direction (0308) so that the plug seats against a seating surface in the toe valve (0310). According to another preferred exemplary embodiment, a pressure increase and held steady at the wellhead indicates seating against the upstream end of the toe valve. Factors such as pump down efficiency, volume of the fluid pumped and geometry of the well may be utilized to check for the seating of the restriction plug element in the toe valve. For example, in a 5.5 inch diameter wellbore casing, the amount of pumping fluid may be 250 barrels for a restriction plug to travel 10,000 ft. Therefore, the amount of pumping fluid may be used as an indication to determine the location and seating of a plug.

According to a preferred exemplary embodiment the plug is degradable in wellbore fluids with or without a chemical reaction. According to another preferred exemplary embodiment the plug is non-degradable in wellbore fluids. The plug (0302) may pass through all the unactuated downhole tools (0311, 0312, 0313, 0314) and land on a seat in an upstream end of a tool that is upstream of the injection point. The inner diameters of the downhole tools may be large enough to enable pass through of the plug (0302). According to a further exemplary embodiment, the first injection point may be initiated from any of the downhole tools. For example, an injection point may be initiated through a port in sliding sleeve valve (0312) and a restriction plug element may land against a seat in sliding sleeve valve (0312). The restriction plug element in the aforementioned example may pass through each of the unactuated sliding sleeve valves (0313, 0314) that are upstream to the injection point created in sliding sleeve valve (0312). According to another preferred exemplary embodiment the restriction plug element shapes are selected from a group consisting of: a sphere, a cylinder, and a dart. According to a preferred exemplary embodiment the restriction plug element materials are selected from a group consisting of a metal, a non-metal, and a ceramic. According to yet another preferred exemplary embodiment, restriction plug element (0302) may be degradable over time in the well fluids eliminating the need for them to be removed before production. The restriction plug element (0302) degradation may also be accelerated by acidic components of hydraulic fracturing fluids or wellbore fluids, thereby reducing the diameter of restriction plug element (0302) and enabling the plug to flow out (pumped out) of the wellbore casing or flow back (pumped back) to the surface before production phase commences.

Figure 3C:
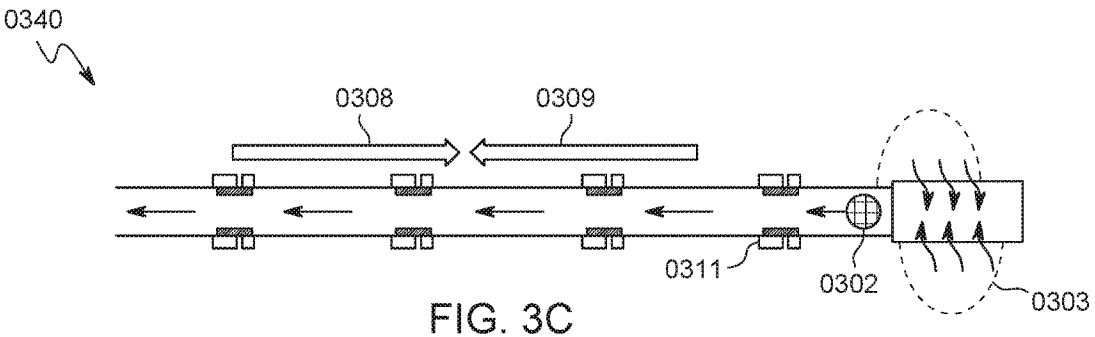
Figure 3D:
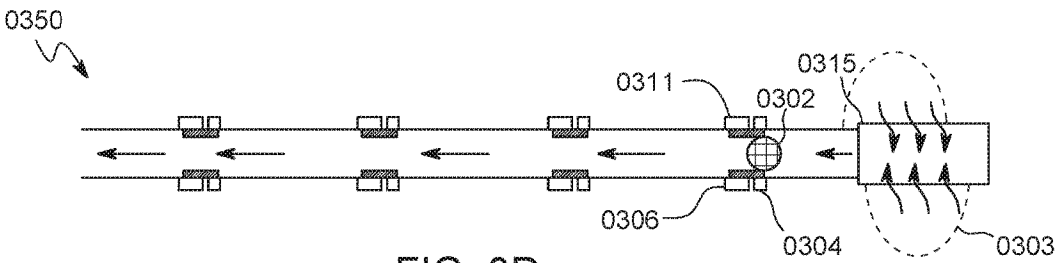

FIG. 3C (0340) and FIG. 3D (0350) generally illustrate a reverse flow of the well wherein the pumping at the wellhead is reduced or stopped. The pressure in the formation may be higher than the pressure in the well casing and therefore pressure is balanced in the well casing resulting in fluid flow back from the connected region (0303) into the casing (0301). The stored energy in the connected region (0303) may be released into the casing that may result in a reverse flow of fluid in an upstream direction (0309) from toe end to heel end. The reverse flow action may cause the restriction plug element to flow back from an upstream end (0315) of the toe valve (0310) to a downstream end (0304) of a sliding sleeve valve (0311). According to a preferred exemplary embodiment the sliding sleeve valve is positioned upstream of the injection point in the toe valve. An increase in the reverse flow may further deform the restriction plug element (0302) and enable the restriction plug element to engage onto the downstream end (0304) of the sliding sleeve valve (0311). The deformation of the restriction plug element (0302) may be such that the plug does not pass through the sliding sleeve valve in an upstream direction. According to a preferred exemplary embodiment, an inner diameter of the sliding sleeve valve is lesser than a diameter of the restriction element such that the restriction element does not pass through said the sliding sleeve in an upstream direction. According to another preferred exemplary embodiment, a pressure drop off at the wellhead indicates seating against the downstream end of the sliding sleeve valve.

Figure 3E:
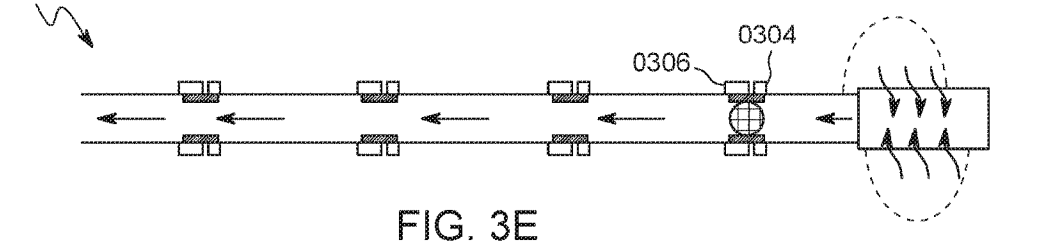

FIG. 3E (0360) generally illustrates a restriction plug element (0302) actuating the sliding sleeve valve (0311) as a result of the reverse flow from downstream to upstream. According to a preferred exemplary embodiment, the actuation of the valve (0311) also reconfigures the upstream end of the valve (0311) and creates a seating surface for subsequent restriction plug elements to seat in the seating surface. A more detailed description of the valve reconfiguration is further illustrated in FIG. 4A-FIG. 4E. According to a preferred exemplary embodiment, a sleeve in the sliding sleeve valve travels in a direction from downstream to upstream and enables ports in the first sliding sleeve valve to open fluid communication to the hydrocarbon formation. According to a preferred exemplary embodiment, a pressure differential at the wellhead may indicate pressure required to actuate the sliding sleeve valve. Each of the sliding sleeve valves may actuate at a different pressure differential ($\Delta P$). For example valve (0311) may have a pressure differential of 1000 PSI, valve (0311) may have a pressure differential of 1200 PSI. According to another preferred exemplary embodiment, the pressure differential to actuate a downhole tool may indicate a location of the downhole tool being actuated.

Figure 3F:
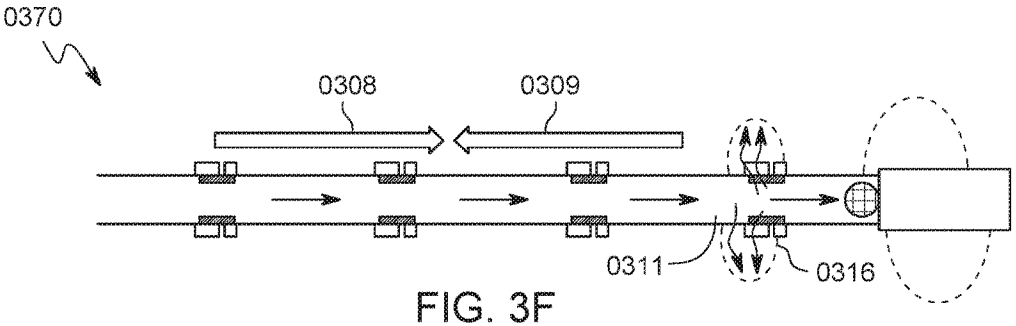

After the sliding sleeve valve (0311) is actuated as illustrated in FIG. 3E (0360), fluid may be pumped into the casing (0301) as generally illustrated in FIG. 3F (0370). The fluid flow may change to downstream (0308) direction as the fluid is pumped down. A second injection point and a second connected region (0316) may be created through a port in the sliding sleeve valve (0311). Similar to the connected region (0303), connected region (0316) may be a region of stored energy that may be utilized for useful work.

Figure 3G:
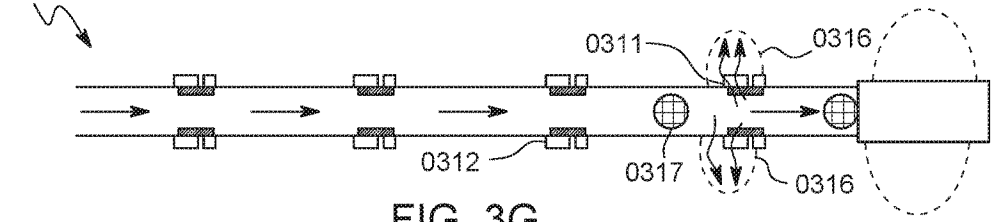

As generally illustrated in FIG. 3G (0380), a second restriction plug element (0317) may be pumped into the wellbore casing (0301). The plug (0317) may seat against the seating surface created in an upstream end (0306) during the reconfiguration of the valve as illustrated in FIG. 3E (0360). The plug (0317) may pass through each of the unactuated sliding sleeve valves (0314, 0313, 0312) before seating against the seating surface.

Figure 3H:
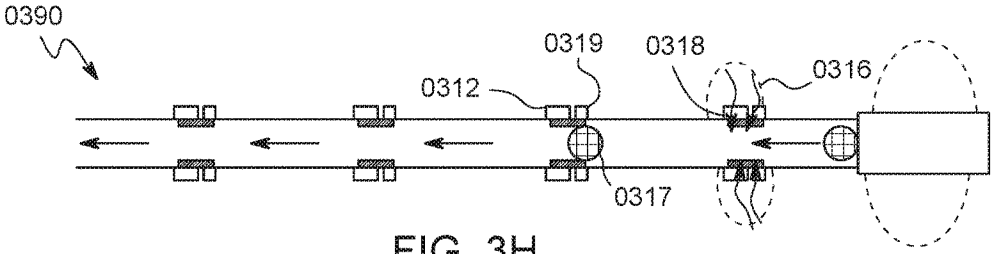

FIG. 3H (0390) generally illustrates a reverse flow of the well wherein the pumping at the wellhead is reduced or stopped similar to the illustration in FIG. 3C (0350). The pressure in the formation may be higher than the pressure in the well casing and therefore pressure is balanced in the well casing resulting in fluid flow back from the connected region (0316) into the casing (0301). The stored energy in the connected region (0316) may be released into the casing that may result in a reverse flow of fluid in an upstream direction (0309) from toe end to heel end. The reverse flow action may cause the restriction plug element (0317) to flow back from an upstream end (0318) of the sliding sleeve valve (0311) to a downstream end (0319) of a sliding sleeve valve (0312). Upon further increase of the reverse flow, the plug (0317) may deform and engage on the downstream end (0319) of the valve (0312). The plug (0317) may further actuate the valve (0312) in a reverse direction from downstream to upstream. Conventional sliding sleeve valves are actuated from upstream to downstream as opposed to the exemplary reverse flow actuation as aforementioned.

Preferred Embodiment Reverse Flow Sleeve Actuation (0400)

Figures 4A, 4B, 4C:
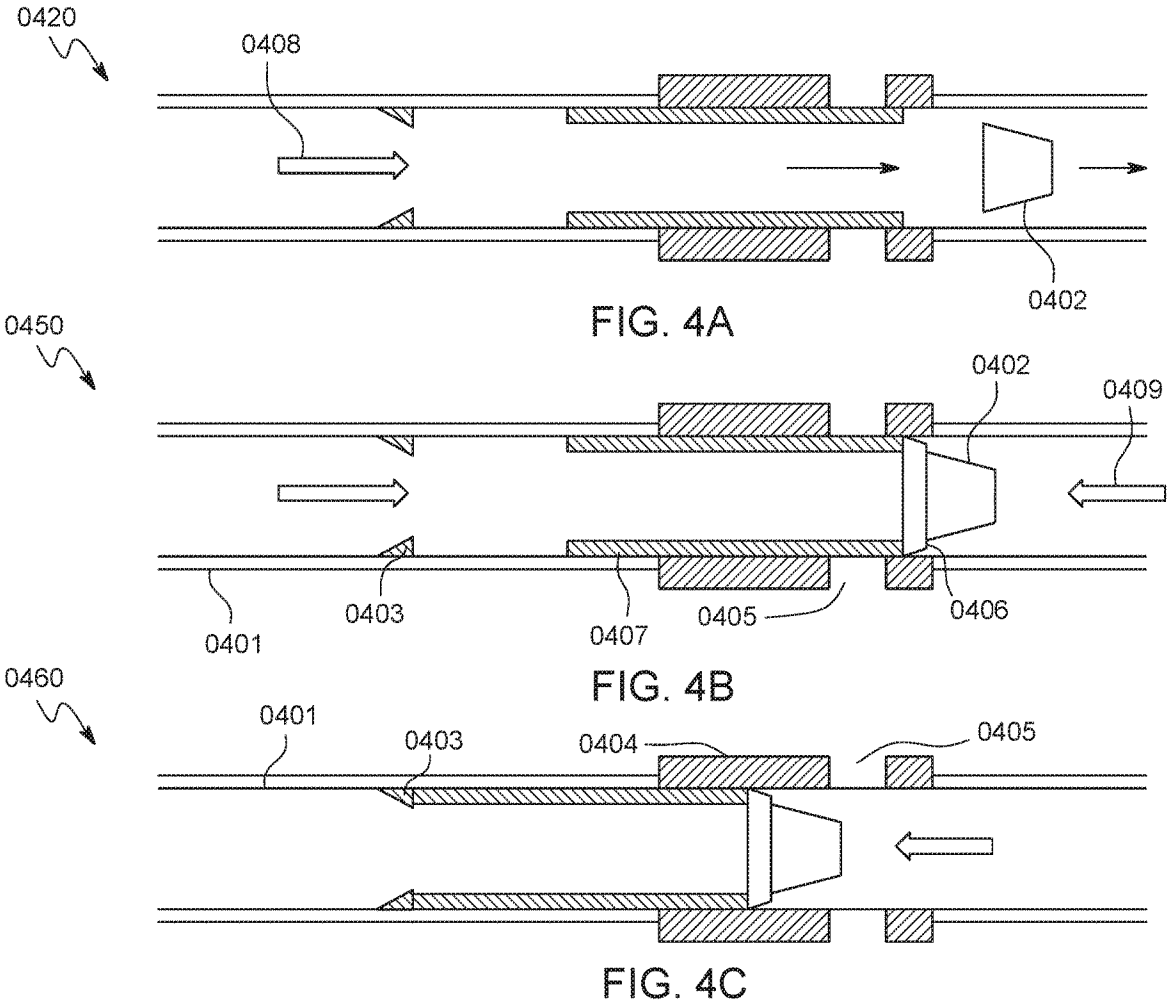
FIG. 4A-4C illustrate a system overview depicting an exemplary reverse flow actuation of sliding sleeves comprising a restriction feature and a reconfigurable seat according to a presently preferred embodiment of the present invention.

As generally illustrated in FIG. 4A (0420), FIG. 4B (0440) and FIG. 4C (0460), a sliding sleeve valve installed in a wellbore casing (0401) comprises an outer mandrel (0404) and an inner sleeve with a restriction feature (0406). The sliding sleeves (0311, 0312, 0313, 0314) illustrated in FIG. 3A-3H may be similar to the sliding sleeves illustrated in FIG. 4A-4C. A restriction plug element may change shape when the flow reverses. As generally illustrated in FIG. 4A (0420) and FIG. 4B (0440) the restriction plug (0402) deforms and changes shape due to the reverse flow or other means such as temperature conditions and wellbore fluid interaction. The restriction plug element (0402) may engage onto the restriction feature (0406) and enable the inner sleeve (0407) to slide when a reverse flow is established in the upstream direction (0409). When the inner sleeve slides as illustrated in FIG. 4C (0460), ports (0405) in the mandrel (0404) open such that fluid communication is established to a hydrocarbon formation. According to a preferred exemplary embodiment, the restriction feature engages the restriction plug element on a downstream end of the sliding sleeve when a reverse flow is initiated. The sleeve may further reconfigure to create a seat (0403) when reverse flow continues and the valve is actuated.

Preferred Exemplary Reverse Flow Sleeve Actuation Flowchart Embodiment (0500)

Figure 5B:
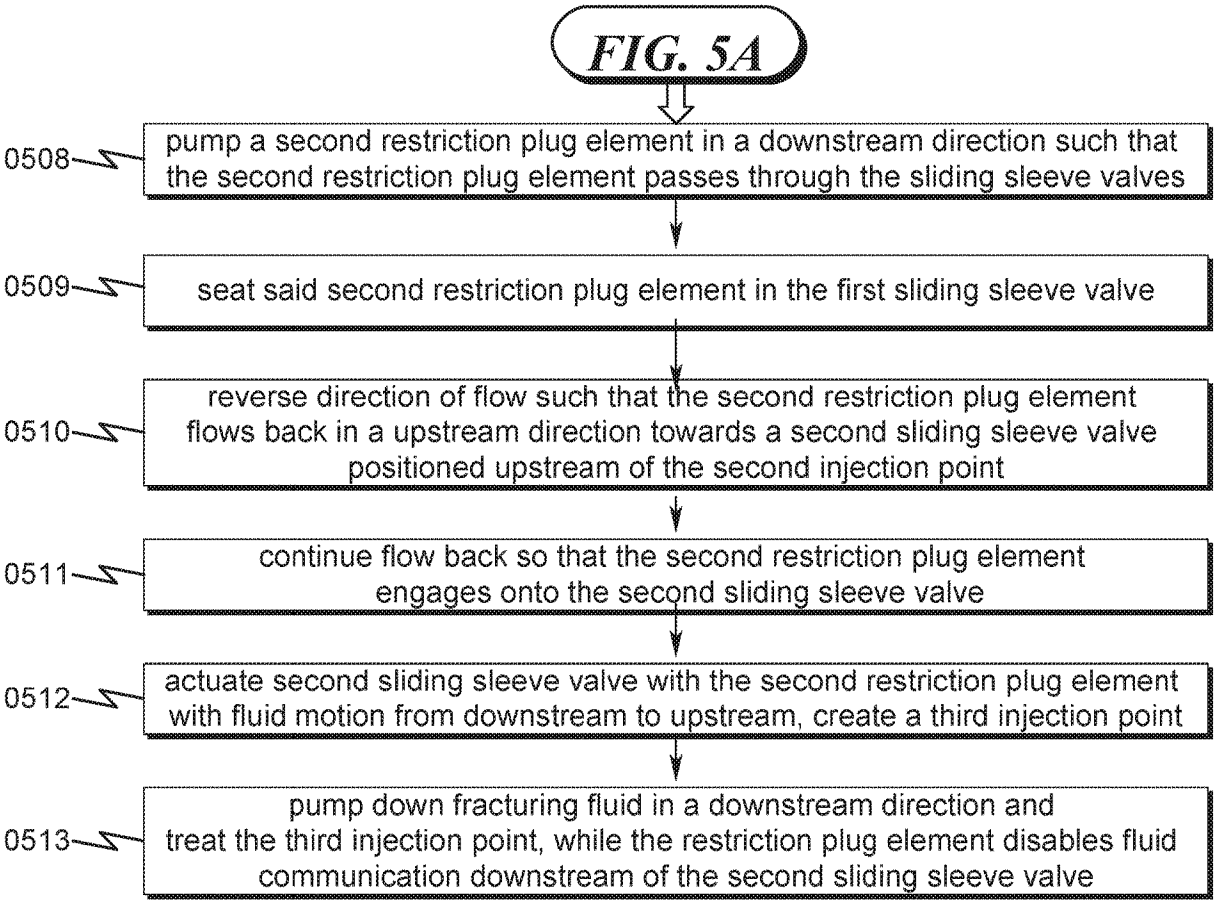

As generally seen in the flow chart of FIG. 5A and FIG. 5B (0500), a preferred exemplary reverse flow sleeve actuation method may be generally described in terms of the following steps:

(1) installing the wellbore casing along with sliding sleeve valves at predefined positions (0501);

(2) creating and treating a first injection point to a hydrocarbon formation (0502);

The first injection point may be in a toe valve as illustrated in FIG. 3A. The first injection point may be in any of the downhole tools such as the sliding sleeve valves (0311, 0312, 0313, 0314). The first injection point may be created by opening communication through a port in the toe valve. The first injection point may then be treated with treatment fluid so that energy is stored in the connected region.

(3) pumping a first restriction plug element in a downstream direction such that the first restriction plug element passes the unactuated sliding sleeve valves (0503);

The first restriction plug element may be a fracturing ball (0302) as illustrated in FIG. 3B. The fracturing ball (0302) may pass through the unactuated sliding sleeve valves (0311, 0312, 0313, 0314).

(4) reversing direction of flow such that the first restriction plug element flows back in an upstream direction towards a first sliding sleeve valve; the first sliding sleeve valve positioned upstream of the first injection point (0504);

The pumping rate at the wellhead may be slowed down or stopped so that a reverse flow of the fluid initiates from a connected region, for example connected region (0303) illustrated in FIG. 3C. The reverse flow may be from toe end to heel end in an upstream direction (0309).

(5) continuing flow back so that the first restriction plug element engages onto the first sliding sleeve valve (0505);

As illustrated in FIG. 3D the reverse flow may continue such that the plug element (0302) may engage onto a downstream end (0304) of the first sliding sleeve valve (0311).

(6) actuating the first sliding sleeve valve with the first restriction plug element with fluid motion from downstream to upstream and creating a second injection point (0506);

As illustrated in FIG. 3E, the plug element (0302) may actuate a sleeve in the sliding valve (0311) as the reverse flow continues with fluid motion from toe end to heel end. The first sliding sleeve valve may reconfigure during the actuation process such that a seating surface is created on the upstream end (0306) of the sliding sleeve valve (0311). The second injection point may be created by opening communication through a port in the first sliding sleeve valve.

The first sliding sleeve valve (0311) may further comprise a pressure actuating device such as a rupture disk. The pressure actuating device may be armed by exposure to wellbore. During the reverse flow a pressure port in the sliding sleeve valve (0311) may be opened so that the rupture disk is armed. The sleeve may then be actuated by pumping down fluid. The reverse flow may be adequate for the pressure actuating device to be armed and a higher pump down pressure may actuate the sleeve. The sliding sleeve may also comprise a hydraulic time delay element that delays the opening of the valve.

(7) pumping down treatment fluid in the downstream direction and treating the second injection point, while the first restriction plug element disables fluid communication downstream of the first sliding sleeve valve (0507);

After the sleeve is actuated in step (6), pumping rate of the fluid may be increased in a downstream direction (0308) so that the second injection point (0316) may be treated as illustrated in FIG. 3F. Fluid communication may be established to the hydrocarbon formation.

(8) pumping a second restriction plug element in a downstream direction such that the second restriction plug element passes through the sliding sleeve valves (0508);

As illustrated in FIG. 3G, a second plug (0317) may be deployed into the casing. The second plug (0317) may pass through each of the unactuated sliding sleeve valves (0312, 0313, 0314) in a downstream direction.

(9) seating the second restriction plug element in the first sliding sleeve valve (0509);

The second plug (0317) may seat in the seating surface that is created on the upstream end (0306) of the sliding sleeve valve (0311) as illustrated in FIG. 3H.

(10) reversing direction of flow such that the second restriction plug element flows back in an upstream direction towards a second sliding sleeve valve positioned upstream of the second injection point (0510);

Flow may be reversed similar to step (4) so that fluid flows from the connected region (0316) into the wellbore casing (0310). The motion of the reverse flow may enable the second plug (0317) to travel in an upstream direction (0309).

(11) continuing flow back so that the second restriction plug element engages onto the second sliding sleeve valve (0511);

Continuing the reverse flow may further enable the second plug (0317) to engage onto a downstream end of the second sliding sleeve valve (0312).

(12) actuating the second sliding sleeve valve with the second restriction plug element with fluid motion from downstream to upstream and creating a third injection point (0512); and The second sliding sleeve valve (0312) may be actuated by the second plug (0317) in a direction from downstream to upstream.

(13) pumping down treatment fluid in a downstream direction and treating the third injection point, while the restriction plug element disables fluid communication downstream of the second sliding sleeve valve (0513).

Fluid may be pumped in the downstream direction to treat the third injection point while the second plug (0317) disables fluid communication downstream of the third injection point.

The second sliding sleeve valve (0312) may further comprise a pressure actuating device such as a rupture disk. The pressure actuating device may be armed by exposure to wellbore. During the reverse flow a pressure port in the sliding sleeve valve (0312) may be opened so that the rupture disk is armed. The sleeve may then be actuated by pumping down fluid. The reverse flow may be adequate for the pressure actuating device to be armed and a higher pump down pressure may actuate the sleeve. The second sliding sleeve may also comprise a hydraulic time delay element that delays the opening of the valve.

The steps (8)-(13) may be continued until all the stages of the well casing are completed.

Preferred Exemplary Reverse Flow Sleeve Actuation Pressure Chart Embodiment (0600)

Figure 6:
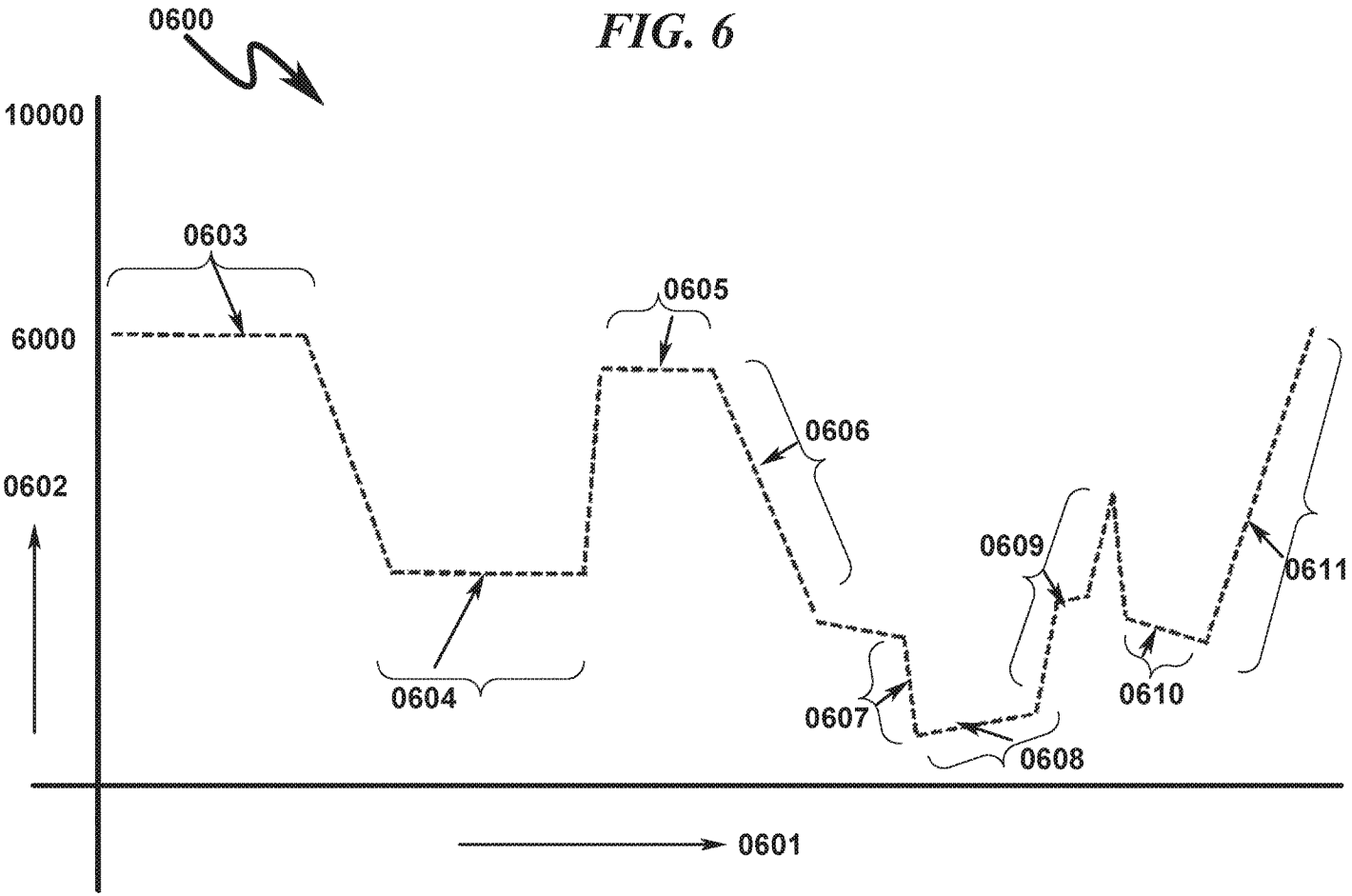
FIG. 6 illustrates an exemplary pressure chart depicting an exemplary reverse flow actuation of downhole tools according to a presently preferred embodiment of the present invention.

A pressure (0602) Vs time (0601) chart ("pressure-time chart") monitored at a well head is generally illustrated in FIG. 6 (0600). The chart may include the following sequence of events in time and the corresponding pressure (1) Pressure (0603) generally corresponds to a pressure when a restriction plug element similar to ball (0302) is pumped into a wellbore casing at a pumping rate of 20 barrels per minute (bpm).

According to a preferred exemplary embodiment the pressure (0603) may range from 3000 PSI to 12,000 PSI. According to a more preferred exemplary embodiment the pressure (0603) may range from 6000 PSI to 8,000 PSI.

(2) Pressure (0604) or seating pressure generally corresponds to a pressure when a ball lands on a seat such as a seat in a toe valve (0310). The pumping rate may be reduced to 4 bpm.

(3) Pressure (0605) may be held when the ball seats against the seat. The pressure may be checked to provide an indication of ball seating as depicted in step (0704) of FIG. 7.

According to a preferred exemplary embodiment the seating pressure (0605) may range from 2000 PSI to 10,000 PSI. According to a more preferred exemplary embodiment the seating pressure (0605) may range from 6000 PSI to 8,000 PSI.

(4) Pumping rate may be slowed down so that fluid from a connected region may flow into the casing and result in a pressure drop (0606).

For example, the pumping rate may be slowed down from 20 bpm to 1 bpm.

(5) The ball may flow back in an upstream direction due to reverse flow resulting in a further drop in pressure (0607).

(6) A sleeve such as sleeve (0311) may be actuated with a pressure differential (0608). The pressure differential may be different for each of the sliding sleeves. As more injection points are opened up upstream in sliding sleeves, the pressure differential may decrease and a location of the sliding sleeve may be determined based on the pressure differential. An improper pressure differential may also indicate a leak past the ball.

According to a preferred exemplary embodiment the differential pressure (0608) may range from 1000 PSI to 5,000 PSI. According to a more preferred exemplary embodiment the seating pressure (0608) may range from 1000 PSI to 3,000 PSI. According to a most preferred exemplary embodiment the seating pressure (0608) may range from 1000 PSI to 2,000 PSI.

(7) After a sleeve is actuated, pressure (0609) may be increased to open the sleeve and seat the ball in the downhole tool.

(8) Establishing a second injection point in the sleeve (0311), pressure drop (0610) may result due to the release of pressure into the connected region through the second injection point.

(9) The pumping rate of the fluid to be injected and pressure increased (0611) so that injection is performed through the second injection point.

Preferred Exemplary Reverse Flow Sleeve Actuation Flowchart Embodiment (0700)

Figure 7:
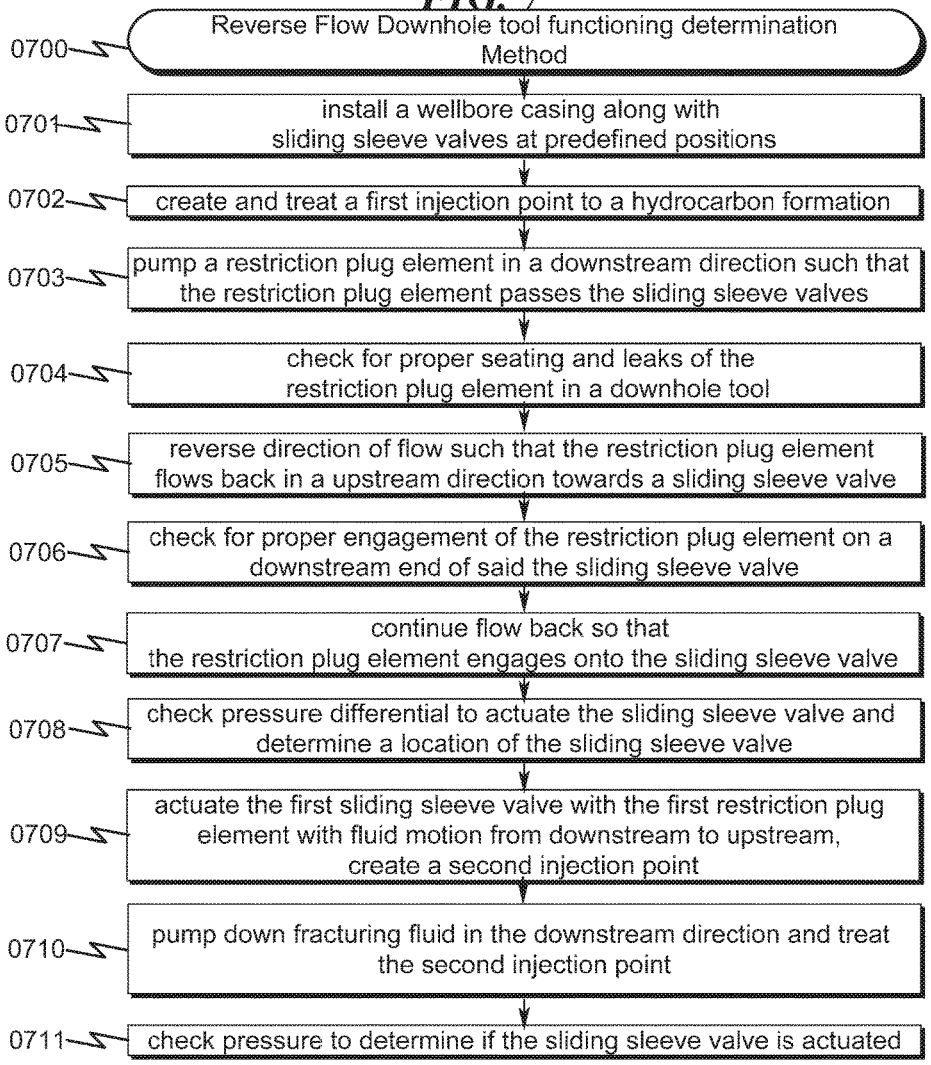
FIG. 7 illustrates a detailed flowchart of a preferred exemplary sleeve functioning determination method used in some exemplary invention embodiments.

As generally seen in the flow chart of FIG. 7 (0700), a preferred exemplary method for determining proper functionality of sliding sleeve valves may be generally described in terms of the following steps:

(1) installing the wellbore casing along with the sliding sleeve valves at predefined positions (0701);

(2) creating a first injection point to a hydrocarbon formation (0702);

(3) pumping a first restriction plug element in a downstream direction such that the restriction plug element passes unactuated the sliding sleeve valves (0703);

(4) checking for proper seating of the restriction plug element in a downhole tool (0704);

(5) reversing direction of flow such that the restriction plug element flows back in an upstream direction towards a sliding sleeve valve; the sliding sleeve valve positioned upstream of the first injection point (0705);

(6) continuing flow back so that the restriction plug element engages onto the sliding sleeve valve (0706);

(7) checking for proper engagement of the restriction plug element on a downstream end of the sliding sleeve valve (0707);

(8) actuating the sliding sleeve valve with the restriction plug element with fluid motion from downstream to upstream (0708);

(9) checking pressure differential to actuate the sliding sleeve and determining a location of the sliding sleeve valve (0709);

(10) pumping down treatment fluid in the downstream direction and creating a second injection point, while the restriction plug element disables fluid communication downstream of the sliding sleeve valve (0710); and

(11) checking pressure to determine if the sliding sleeve valve is actuated (0711).

Preferred Exemplary Reverse Flow Sleeve Actuation Flowchart Embodiment (0800)

Figure 8B:
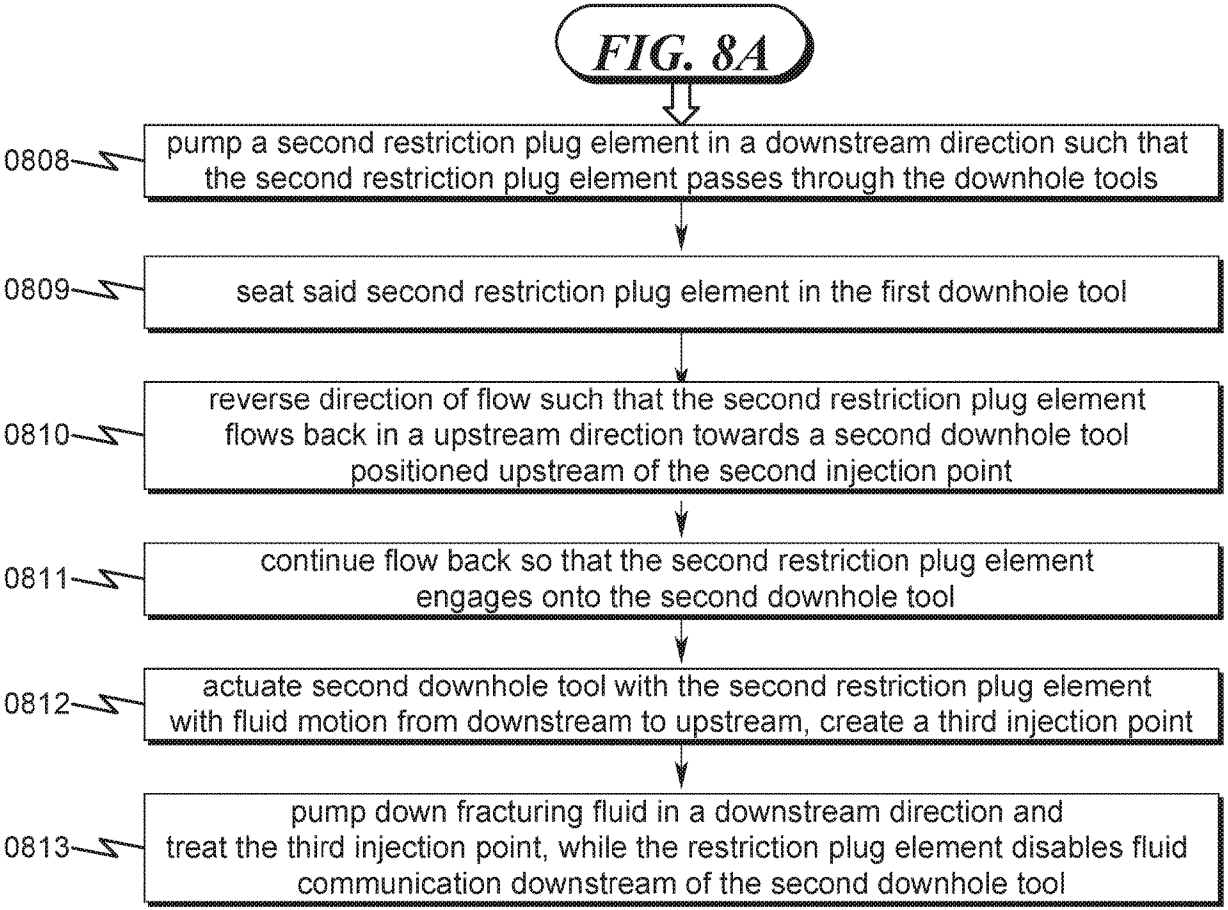

As generally seen in the flow chart of FIG. 8A and FIG. 8B (0800), a preferred exemplary reverse flow downhole tool actuation method may be generally described in terms of the following steps:

(1) installing the wellbore casing along with downhole tools at predefined positions (0801);

The downhole tools may be sliding sleeve valves, restriction plugs, and deployable seats. The downhole tools may be installed in a wellbore casing or any tubing string.

(2) creating and treating a first injection point to a hydrocarbon formation (0802);

The first injection point may be in a toe valve as illustrated in FIG. 3A. The first injection point may be in any of the downhole tools such as the downhole tools (0311, 0312, 0313, 0314). The first injection point may be created by opening communication through a port in the toe valve. The first injection point may then be treated with treatment fluid so that energy is stored in the connected region.

(3) pumping a first restriction plug element in a downstream direction such that the first restriction plug element passes the unactuated downhole tools (0803);

The first restriction plug element may be a fracturing ball (0302) as illustrated in FIG. 3B. The fracturing ball (0302) may pass through the unactuated downhole tools (0311, 0312, 0313, 0314).

(4) reversing direction of flow such that the first restriction plug element flows back in an upstream direction towards a first downhole tool; the first downhole tool positioned upstream of the first injection point (0804);

The pumping rate at the wellhead may be slowed down or stopped so that a reverse flow of the fluid initiates from a connected region, for example connected region (0303) illustrated in FIG. 3C. The reverse flow may be from toe end to heel end in an upstream direction (0309).

(5) continuing flow back so that the first restriction plug element engages onto the first downhole tool (0808);

As illustrated in FIG. 3D the reverse flow may continue such that the plug element (0302) may engage onto a downstream end (0304) of the first downhole tool (0311).

(6) actuating the first downhole tool with the first restriction plug element with fluid motion from downstream to upstream and creating a second injection point (0806);

As illustrated in FIG. 3E, the plug element (0302) may actuate a sleeve in the sliding valve (0311) as the reverse flow continues with fluid motion from toe end to heel end. The first downhole tool may reconfigure during the actuation process such that a seating surface is created on the upstream end (0306) of the downhole tool (0311). The second injection point may be created by opening communication through a port in the first downhole tool.

The first downhole tool (0311) may further comprise a pressure actuating device such as a rupture disk. The pressure actuating device may be armed by exposure to wellbore. During the reverse flow a pressure port in the downhole tool (0311) may be opened so that the rupture disk is armed. The sleeve may then be actuated by pumping down fluid. The reverse flow may be adequate for the pressure actuating device to be armed and a higher pump down pressure may actuate the sleeve. The sliding sleeve may also comprise a hydraulic time delay element that delays the opening of the valve.

(7) pumping down treatment fluid in the downstream direction and treating the second injection point, while the first restriction plug element disables fluid communication downstream of the first downhole tool (0807);

After the sleeve is actuated in step (6), pumping rate of the fluid may be increased in a downstream direction (0308) so that the second injection point (0316) may be treated as illustrated in FIG. 3F. Fluid communication may be established to the hydrocarbon formation.

(8) pumping a second restriction plug element in a downstream direction such that the second restriction plug element passes through the downhole tools (0808);

As illustrated in FIG. 3G, a second plug (0317) may be deployed into the casing. The second plug (0317) may pass through each of the unactuated downhole tools (0312, 0313, 0314) in a downstream direction.

(9) seating the second restriction plug element in the first downhole tool (0809);

The second plug (0317) may seat in the seating surface that is created on the upstream end (0306) of the downhole tool (0311) as illustrated in FIG. 3H.

(10) reversing direction of flow such that the second restriction plug element flows back in an upstream direction towards a second downhole tool positioned upstream of the second injection point (0810);

Flow may be reversed similar to step (4) so that fluid flows from the connected region (0316) into the wellbore casing (0310). The motion of the reverse flow may enable the second plug (0317) to travel in an upstream direction (0309).

(11) continuing flow back so that the second restriction plug element engages onto the second downhole tool (0811);

Continuing the reverse flow may further enable the second plug (0317) to engage onto a downstream end of the second downhole tool (0312).

(12) actuating the second downhole tool with the second restriction plug element with fluid motion from downstream to upstream and creating a third injection point (0812); and The second downhole tool (0312) may be actuated by the second plug (0317) in a direction from downstream to upstream.

(13) pumping down treatment fluid in a downstream direction and treating the third injection point, while the restriction plug element disables fluid communication downstream of the second downhole tool (0813).

Fluid may be pumped in the downstream direction to treat the third injection point while the second plug (0317) disables fluid communication downstream of the third injection point.

The second downhole tool (0312) may further comprise a pressure actuating device such as a rupture disk. The pressure actuating device may be armed by exposure to wellbore. During the reverse flow a pressure port in the downhole tool (0312) may be opened so that the rupture disk is armed. The sleeve may then be actuated by pumping down fluid. The reverse flow may be adequate for the pressure actuating device to be armed and a higher pump down pressure may actuate the sleeve. The second sliding sleeve may also comprise a hydraulic time delay element that delays the opening of the valve.

The steps (8)-(13) may be continued until all the stages of the well casing are completed.

Method Summary

The present invention method anticipates a wide variety of variations in the basic theme of implementation, but can be generalized as a reverse flow sleeve actuation method; wherein the method comprises the steps of:

(1) installing the wellbore casing along with sliding sleeve valves at predefined positions;

(2) creating and treating a first injection point to a hydrocarbon formation;

(3) pumping a first restriction plug element in a downstream direction such that the first restriction plug element passes through unactuated the sliding sleeve valves;

(4) reversing direction of flow such that the first restriction plug element flows back in an upstream direction towards a first sliding sleeve valve; the first sliding sleeve valve positioned upstream of the first injection point;

(5) continuing flow back so that the first restriction plug element engages onto the first sliding sleeve valve;

(6) actuating the first sliding sleeve valve with the first restriction plug element with fluid motion from downstream to upstream and creating a second injection point; and (7) pumping down treatment fluid in the downstream direction and treating the second injection point, while the first restriction plug element disables fluid communication downstream of the first sliding sleeve valve.

This general method summary may be augmented by the various elements described herein to produce a wide variety of invention embodiments consistent with this overall design description.

The general method summary described above may further be augmented with the following method steps:

(8) pumping a second restriction plug element in a downstream direction such that the second restriction plug element passes through the sliding sleeve valves;

(9) seating the second restriction plug element in the first sliding sleeve valve;

(10) reversing direction of flow such that the second restriction plug element flows back in an upstream direction towards a second sliding sleeve valve positioned upstream of the second injection point;

(11) continuing flow back so that the second restriction plug element engages onto the second sliding sleeve valve;

(12) actuating the second sliding sleeve valve with the second restriction plug element with fluid motion from downstream to upstream and creating a third injection point; and

(13) pumping down treatment fluid in a downstream direction and treating the third injection point, while the restriction plug element disables fluid communication downstream of the second sliding sleeve valve.

Method Variations

The present invention anticipates a wide variety of variations in the basic theme of hydrocarbon extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the first injection point is created in a toe valve at a toe end of the wellbore casing.

An embodiment wherein the first restriction plug elements is seating in an upstream end of the toe valve.

An embodiment wherein the first injection point is created in a downhole tool of the wellbore casing at any of the predefined positions.

An embodiment wherein the reversing direction of flow step (4) is enabled by stopping pumping and releasing stored energy in the first injection point.

An embodiment wherein when the first restriction element deforms in the step (5), an inner diameter of the first sliding sleeve valve is lesser than diameter of the first restriction element such that the first restriction element does not pass through the first sliding sleeve in an upstream direction.

An embodiment wherein the second sliding sleeve valve is positioned upstream of the first sliding sleeve valve.

An embodiment wherein the third injection point is located upstream of the second injection point and the second injection point is located upstream of the first injection point.

An embodiment wherein when the first sliding sleeve valve is actuated in the step (6), a sleeve in the first sliding sleeve valve travels in a direction from downstream to upstream and enables ports in the first sliding sleeve valve to open fluid communication to the hydrocarbon formation.

An embodiment wherein when the first restriction element deforms in the step (5), a restriction feature in a downstream end of the first sliding sleeve valve engages the first restriction element.

An embodiment wherein when the first restriction element actuates the first sliding sleeve valve in the step (6), the first sliding sleeve valve reconfigures to create a seat at an upstream end such that the second restriction element seats against the seat in the step (9).

An embodiment wherein the first restriction plug element and second restriction plug element are degradable.

An embodiment wherein the first restriction plug element and second restriction plug element are non-degradable.

An embodiment wherein the first restriction plug element and second restriction plug element materials are selected from a group consisting of: a metal, a non-metal, and a ceramic.

An embodiment wherein the first restriction plug element and second restriction plug element shapes are selected from a group consisting of: a sphere, a cylinder, and a dart.

An embodiment wherein inner diameters of each of the sliding sleeve valves are same.

An embodiment wherein a ratio of an inner diameter of each of the sliding sleeve valves to an inner diameter of the wellbore casing ranges from 0.5 to 1.2.

An embodiment wherein a ratio of an inner diameter of the first sliding sleeve valve to an inner diameter of the second sliding sleeve valve ranges from 0.5 to 1.2.

One skilled in the art will recognize that other embodiments are possible based on combinations of elements taught within the above invention description.

CONCLUSION

A sleeve actuation method for actuating sleeves in a reverse direction has been disclosed. The method includes a use of stored energy created by injecting into a connected region of a well such that the stored energy is used to actuate a tool installed in a wellbore casing that is either heel ward or uphole of the connected region. The tool actuated in a direction from toe end to heel end while the tool reconfigures to create a seat for seating plugging elements.

What is claimed is:

1. A method for monitoring actuation and location of sliding sleeve valves in a wellbore casing, wherein said method comprises the steps of:

(1) installing said wellbore casing along with said sliding sleeve valves at predefined positions;

(2) creating and treating a first injection point into a hydrocarbon formation;

(3) pumping a restriction plug element in a downstream direction such that said restriction plug element passes through unactuated said sliding sleeve valves;

(4) checking pressure and comparing with a seating pressure from a pressure-time chart for proper seating of said restriction plug element in a downhole tool;

(5) reversing direction of flow such that said restriction plug element flows back in an upstream direction towards a first sliding sleeve valve;

(6) continuing flow back so that said restriction plug element engages onto said first sliding sleeve valve;

(7) sensing pressure and comparing pressure from said pressure-time chart and checking for proper engagement of said restriction plug element on a downstream end of said first sliding sleeve valve;

(8) actuating said first sliding sleeve valve with said restriction plug element with fluid motion from downstream to upstream direction;

(9) sensing pressure and comparing with a differential pressure from said pressure-time chart and determining location of said first sliding sleeve based on sensing pressure;

(10) creating a second injection point and pumping down treatment fluid in said downstream direction and treating the second injection point, while said first restriction plug element disables fluid communication downstream of said first sliding sleeve valve; and

(11) sensing pressure and comparing pressure from said pressure-time chart to determine if said first sliding sleeve valve is actuated.

2. The method of claim 1 wherein said first injection point is created in a toe valve at a toe end in said wellbore casing.

3. The method of claim 1 wherein an operator at a wellhead monitors said pressure chart monitor.

4. The method of claim 1 wherein said seating pressure ranges from 2000 PSI to 10,000 PSI.

5. The method of claim 1 wherein said differential pressure ranges from 1000 PSI to 5000 PSI.

6. The sliding sleeve actuation method of claim 1 wherein said reversing direction of flow step (5) is enabled by stopping pumping and releasing stored energy in said first injection point.

* * * * *